US007431798B2

(12) United States Patent
Watson

(10) Patent No.: US 7,431,798 B2
(45) Date of Patent: Oct. 7, 2008

(54) SECURITY PAPER

(75) Inventor: Mark Victor Watson, Thame (GB)

(73) Assignee: Arjo Wiggins Fine Papers Ltd., Chineham, Basingstoke (GB)

( * ) Notice: Subject to any disclaimer, the term of this patent is extended or adjusted under 35 U.S.C. 154(b) by 0 days.

(21) Appl. No.: 10/432,620

(22) PCT Filed: Dec. 5, 2001

(86) PCT No.: PCT/GB01/05379

§ 371 (c)(1),
(2), (4) Date: Jun. 5, 2003

(87) PCT Pub. No.: WO02/46529

PCT Pub. Date: Jun. 13, 2002

(65) Prior Publication Data

US 2004/0007340 A1 Jan. 15, 2004

(30) Foreign Application Priority Data

Dec. 9, 2000 (GB) ..... 0030132.5

(51) Int. Cl.
*D21H 21/40* (2006.01)

(52) U.S. Cl. ..... 162/140; 162/134; 162/135; 162/175; 162/168.1; 162/169; 428/206; 283/58; 283/72

(58) Field of Classification Search ..... 162/134–135, 162/140, 169, 175, 168.1, 158, 164.1; 428/340–341, 428/206; 283/72, 58, 103
See application file for complete search history.

(56) References Cited

U.S. PATENT DOCUMENTS

| | | | | |
|---|---|---|---|---|
| 4,445,970 | A * | 5/1984 | Post et al. | 162/135 |
| 4,942,410 | A | 7/1990 | Fitch et al. | |
| 5,449,200 | A * | 9/1995 | Andric et al. | 283/67 |
| 5,647,898 | A * | 7/1997 | Fuertes et al. | 106/162.1 |
| 5,824,190 | A * | 10/1998 | Guerro et al. | 162/135 |
| 5,868,902 | A * | 2/1999 | Howland et al. | 162/140 |
| 5,928,471 | A | 7/1999 | Howland et al. | |
| 6,022,450 | A * | 2/2000 | Van Kessel et al. | 162/174 |
| 6,034,181 | A * | 3/2000 | Bazaj et al. | 525/218 |
| 6,306,493 | B1 * | 10/2001 | Brownfield | 428/327 |
| 6,391,154 | B1 * | 5/2002 | Nyg.ang.rd et al. | 162/135 |
| 6,406,592 | B2 * | 6/2002 | Leskela et al. | 162/142 |
| 6,630,055 | B1 * | 10/2003 | Goguelin et al. | 162/136 |
| 6,936,317 | B2 * | 8/2005 | Watson et al. | 428/32.37 |
| 2001/0008178 | A1 * | 7/2001 | Laskela et al. | 162/65 |
| 2002/0122931 | A1 * | 9/2002 | Brownfield et al. | 428/324 |
| 2004/0007340 | A1 * | 1/2004 | Watson | 162/140 |
| 2004/0060678 | A1 * | 4/2004 | Eriksson et al. | 162/198 |
| 2004/0168779 | A1 * | 9/2004 | Silenius et al. | 162/124 |
| 2007/0017647 | A1 * | 1/2007 | Habik et al. | 162/140 |

FOREIGN PATENT DOCUMENTS

| | | | |
|---|---|---|---|
| DE | 195 10 974 | | 9/1996 |
| EP | 0 041 056 | | 12/1981 |
| EP | 0 747 235 | A2 | 12/1996 |
| EP | 747235 | A2 * | 12/1996 |
| EP | 0 860 547 | A2 | 8/1998 |
| WO | WO 95/27825 | | 10/1995 |
| WO | WO 0246529 | A1 * | 6/2002 |

OTHER PUBLICATIONS

James P. Case, Editor "Pulp and paper Chemistry and Chemical technology, " Third Edition, vol. III, p. 1519.*
Arjo Wiggins, "Newsletter: Laserguar and Jetguard" May 27, 2001, vol. 5, Issue 6.*

* cited by examiner

*Primary Examiner*—José A Fortuna
(74) *Attorney, Agent, or Firm*—Westerman, Hattori, Daniels & Adrian, LLP.

(57) ABSTRACT

Security paper adapted to resist fraudulent alteration of toner-printed information thereon and to make such alteration or attempts at alteration evident has a maximum Scott-Bond strength of 150 J $m^{-2}$; a Bendtsen roughness of not more than about 150 ml $min^{-1}$; and is size press or otherwise treated with a thermally-softenable polymer composition, for example acrylic polymer or copolymer, a polyvinyl acetate polymer, a vinyl acetate/ethylene copolymer, or a vinyl acetate/vinyl chloride/ethylene terpolymer. Preferably the paper has filler content of about 15% to about 20% by weight.

31 Claims, No Drawings

SECURITY PAPER

This invention relates to security paper.

Security documents frequently carry variable information applied by means of a toner printer, most usually a laser printer. The variable information can be, for example, a monetary amount, or the name of a payee, account holder or document owner. Bank cheques, social security or welfare cheques, travellers cheques, money orders, postal orders, bankers drafts, share certificates and other certificates, identity documents, registration documents, driving licences, vehicle road tax licences and other licences or permits, savings or bank account passbooks, travel tickets, vouchers and shipping and other transport documents are examples of such security documents.

Good toner adhesion is particularly important when toner printers are used to fill out details of security documents such as cheques. If the toner is not firmly bound to the paper, there is a risk that toner-printed characters can be removed from the security document using a scalpel or other means and then replaced by other characters. Good toner adhesion is also important if the printed characters are not to become dislodged or abraded on handling or folding of the paper.

The need for good toner adhesion is not of course confined to the security paper field, and various paper treatments have been proposed for enhancing toner adhesion for general applications. For example, U.S. Pat. No. 5,017,416 and International (PCT) Patent Publication No. WO 90/13064 each disclose latex treatment of papers to be printed by an ion deposition process (a type of toner printing in which the toner is bonded to the paper by pressure only, i.e. without the more usual thermal fusion bonding which is a feature of laser printing and most xerographic copying processes). WO 90/13064 expressly refers to potential benefits in relation to prevention of intentional defacement or alteration of printed information.

European Patent Application No. 507998A discloses the use of a low coatweight (3 $gm^{-2}$ or less) coating of silica and a binder for improving toner adhesion. This proposal has the drawback of increasing raw material and process costs, particularly if both surfaces of the paper are to be coated.

International (PCT) Patent Publication No. WO 96/30811 discloses the use of a thin uniform coating of a thermoplastic primer compound applied to at least parts of one side of a security document. The thermoplastic material fuses with toner applied by a hot fusion toner-printing method and so makes fraudulent alteration more difficult.

The use of latex or silica coatings can be effective in creating a better bond between the toner and the paper, but they are not necessarily effective to defeat the most skilful attempts at fraudulent alteration. Furthermore the fact that a fraudulent alteration has been made will not necessarily be readily apparent, because the bond between the coating and the paper to which it is applied may be strong enough to permit toner to be removed whilst leaving the underlying fibrous layer intact.

There is therefore a need for a security paper which not only makes fraudulent removal of toner-printed characters difficult to achieve but also reveals or makes evident that an alteration has been made or attempted, and which does not require costly additional coating operations.

We have now found that the key to this is appropriate manipulation of the internal cohesion of the base paper so as to lower it to a level at which attempts to remove toner from the paper result in visually evident disruption of the cellulose fibres in the sheet (for example, lifting up of fibres, and disruption of watermark features, when present). This critical cohesion level is quantifiable as a maximum Scott bond strength of 150 J $m^{-2}$. Additionally, the inherent toner adhesion must be increased by (a) ensuring that the paper has a sufficiently smooth surface i.e. a Bendtsen roughness not more than 150 ml $min^{-1}$ and (b) by treatment of the paper with a thermally-softenable polymer composition. A size press is advantageously used for carrying out this treatment, since it avoids the need for special coating equipment and operations, but coating, spraying or other treatment methods can be used instead if-desired.

Accordingly, the present invention provides, in a first aspect, security paper adapted to resist fraudulent alteration of toner-printed information thereon and to make such alteration or attempts at alteration evident and which:

(a) has a maximum Scott-Bond strength of 150 J $m^{-2}$;

(b) has a Bendtsen roughness of not more than about 150 ml $min^{-1}$; and (c) has been size press or otherwise treated with a thermally-softenable polymer composition.

In a second aspect, the present invention resides in a security document produced using security paper according to the first aspect of the invention.

In a third aspect, the present invention resides in the use of a security paper according to the first aspect of the invention in the production of a security document for the purpose of making toner-printed information subsequently applied to the security document more resistant to fraudulent alteration and of making such alteration or attempts at alteration evident.

The measurement of Scott-Bond strength is described in Routine Test Method No. 39, Issue No. 1 Nov. 1998 of The Paper Federation of Great Britain (Rivenhall Road, Swindon, SN5 7BD, United Kingdom). Preferably the Scott-Bond strength of the present paper is not more than 140 J $m^{-2}$, even more preferably not more than 130 J $m^{-2}$.

A paper with the desired Scott-Bond value can be obtained by suitable adjustment of the filler content of the paper (the higher the filler content, the lower the internal bond strength). As a rough guide, filler content of the order of 15 to 20% is likely to give the desired Scott-Bond strength in a paper which is otherwise similar to a conventional cheque paper.

Although the present security paper can have a Bendtsen roughness of up to 150 ml $min^{-1}$, a Bendtsen value in the range 60 to 100 ml $min^{-1}$ is preferred. This is readily attainable by standard papermaking techniques, for example by wet pressing and/or calendering.

In addition to being resistant to attempts at fraudulent alteration, most security papers have to comply with well established tensile and tear strength specifications. It is important that manipulation or adjustment of the Scott-Bond strength as described above should not compromise compliance with such specifications. Thus it may be necessary to compensate for the effect of increased filler content on the tensile and tear strength of the paper by, for example, increasing the proportion of softwood in the furnish and by increasing the level of refining of the furnish. For example, for bank cheque paper which has to meet UK Clearing Bank Specification No. 1, the proportion of softwood in the furnish may have to be raised from a level of about 10% to about 20%. $^{w}/_{w}$ (based on dry fibre content only, in both cases).

The thermally softenable polymer composition is typically a latex or a colloidal dispersion. Sytrene-acrylic copolymers are preferred, but alternative possibilities include other acrylic polymers or copolymers, polyvinyl acetate polymers, vinyl acetate/ethylene copolymers, or vinyl acetate/vinyl chloride/ethylene polymers, all in latex or colloidal dispersion form. It should be noted that the chemical composition of the latex has a marked influence on the degree of toner adhesion enhancement obtained.

The thermally softenable polymer is preferably incorporated in a conventional starch surface sizing composition. In the case of a styrene-acrylic copolymer material, the ratio of starch: styrene-acrylic copolymer is preferably about 90:10 on a dry weight basis. Smaller proportions of styrene-acrylic copolymer can be used, down to a minimum of about 5% (i.e. a starch:copolymer ratio of 95:5). Amounts above 10% styrene-acrylic copolymer give increased toner adhesion, up to a limit of about 15%, beyond which no further increase is observed. The increased toner adhesion obtained has to be balanced against the increased raw materials cost involved.

When a starch: styrene-acrylic copolymer size press mixture as described above is used, the solids content should typically be in the range of from about 4-12%, preferably 8-9%. For a typical base paper of, say, 90 $gm^{-2}$ basis weight before sizing, the target wet pick up should be ca. 50-60%, or ca. 5-6% on a dry basis, giving a total dry pick up of ca. 4-5 $gm^{-2}$, i.e. ca.2-2.5 $gm^{-2}$ per side, and a final dry paper of ca. 95 $gm^{-2}$ basis weight.

The guidelines given above in relation to the amount and mode of application of styrene-acrylic copolymer apply also to latexes or colloidal dispersions of the alternative polymers or copolymers referred to above.

The invention will now be illustrated by the following Examples and a Comparative Example (control), in which all parts and percentages are by weight unless otherwise stated, and an asterisk indicates a proprietary trade mark.

EXAMPLE 1

A white woodfree cheque base paper was made on a full-size Fourdrinier paper machine at 100 m $min^{-1}$, without any wet end starch addition. The furnish was 20% softwood fibre, 50% hardwood fiber (eucalyptus) and 30% broke, together with kaolin filler. The paper was surface sized at the size press with a composition comprising (on a dry basis) about 90% starch ("Amylofax" 00 supplied by Avebe UK Ltd of Ulceby, North Linco1nshire, United Kingdom) and. 10% styrene-acrylic copolymer ("Dow* DSP 70" supplied as a colloidal dispersion at 15% solids content by Dow Europe S.A., Horgen, Switzerland). Small amounts of sensitising security chemicals as usually used in cheque base paper production were also present. The size press pick-up was about 5-6% in total on a dry mass basis. The final paper had a basis weight of ca. 95 $gm^{-2}$, a Bendtsen roughness of 100 ml $min^{-1}$, a Scott-Bond strength of 128 J $m^{-2}$ and a filler content (ash content) of 17.8%. The double-sided tape used in the Scott-Bond value determinations was a general purpose grade supplied by Viking Direct, Leicester, UK (catalogue reference G22-DS 10325), and the determinations were carried out in a 50% relative humidity/23° C. controlled environment.

An attempt was made to measure toner adhesion using an IGT AIC 2/5 Tester, in accordance with IGT Toner Adhesion Test Method EN 12283 (Version: Concept 4, November 1999), after samples had been printed using a Hewlett Packard Laserjet 4 Plus Desktop laser printer. However, the sample delaminated i.e. it failed within the paper, rather than at the toner/paper interface, and so no toner adhesion value could be obtained.

Attempts at removing the toner using a scalpel blade resulted in obvious damage to the paper surface.

EXAMPLE 2

The procedure of Example 1 was repeated except that the filler content was 18.4%, and the softwood and hardwood contents were 10% and 60% respectively.

Bendtsen roughness was 70 ml $min^{-1}$ and the Scott-Bond strength was 113 J $m^{-2}$. The IGT toner adhesion test showed delamination and the scalpel test resulted in obvious surface damage.

EXAMPLE 3

The procedure of Example 1 was repeated, except that the filler content was 15.4%, and the softwood and hardwood contents were 30% and 40%, respectively.

The Scott-Bond strength was 107 J $m^{-2}$ and Bendtsen roughness was about 80 ml $min^{-1}$. The IGT toner adhesion and scalpel test results were as in Example 2.

COMPARATIVE EXAMPLE

The procedure of Example 1 was repeated except that the filler content was reduced to 6% and softwood and hardwood fibre contents were 10% and 60%, respectively.

In the IGT toner adhesion test, samples (printed at the same time as in Example 1) did not delaminate and had a measurable toner adhesion of 84%. Scalpel tests showed that while difficult to remove, the paper surface was only slightly damaged.

The key data obtained from Examples 1 to 3 and the Comparative Example are summarised in. Table A below:

TABLE A

| Example | Filler Content (%) | Softwood Content (%) | Scott-Bond Strength (J $m^{-2}$) | Tampering Evident |
|---|---|---|---|---|
| 1 | 17.8 | 20 | 128 | Yes |
| 2 | 18.4 | 10 | 113 | Yes |
| 3 | 15.4 | 30 | 107 | Yes |
| Comp. | 6.0 | 10 | 154 | No |

3000 sheets from each of the above Examples and the Comparative Example were subjected to offset printing using a Heidelberg 2 colour press. All gave good results.

EXAMPLE 4

This illustrates the use of a range of different thermally softenable polymers.

Two sets of rosin-sized handsheets were made, at a target grammage of 85 $gm^{-2}$, from a mixed 70% hardwood (eucalyptus) 30% softwood furnish. The sets had target kaolin filler contents of 3% and 20% respectively, and target Cobb sizing values of 25 ml $m^{-2}$ $min^{-1}$.

Four surface sizing compositions were made up at a solids content of 10%. Each contained 90 parts starch and 10 parts thermally softenable polymer (on a dry weight basis). The starch was "Cerestar*5590", supplied by Cerestar UK Limited, Trafford Park, Manchester, and the polymers were as follows:

(a) polyvinyl acetate ("Vinamul*8481," supplied as a 54-56% solids content emulsion by Vinyl Products Limited of Carshalton, Surrey, UK);

(b) vinyl chloride/vinyl acetate/ethylene terpolymer ("Vinamul*3525", supplied as a 50% solids content emulsion by Vinyl Products Limited);

(c) styrene-acrylic copolymer ("Baysynthol* BMP", supplied as a 26% solids content emulsion by Bayer A. G.); and (d) styrene-acrylic copolymer ("Dow*DSP 70", as used in Examples 1 to 3).

Additionally, a control composition containing starch but no thermally softenable polymer was prepared at 10% solids content.

Each of the above compositions was applied to both sets of the handsheets described above, using a laboratory size press. The dry pick-up was about 5 $gm^{-2}$, so that the treated handsheets had a grammage of about 90 $gm^{-2}$. The treated handsheets were then calendered to a target Bendtsen roughness value well below 150 ml $min^{-1}$.

Scott-Bond strength, Bendtsen roughness, and, where possible, toner adhesion values were then determined for each of the handsheets, and the results obtained are set out in Tables B1 and B2 below for the 3% and 20% kaolin content papers respectively using the same type of tape as in Example 1.

TABLE B1

| | 3% Kaolin Content | | | |
|---|---|---|---|---|
| Polymer | Bendtsen Roughness (ml $min^{-1}$) | Scott-Bond Strength (J $m^{-2}$) | Toner adhesion (%) | Tampering Evident |
| (a) | 89 | 247 | 90 | No |
| (b) | 90 | 165 | 89 | No |
| (c) | 88 | 178 | 91 | No |
| (d) | 78 | 174 | 86 | No |
| None (control) | 77 | 166 | 89 | No |

TABLE B2

| | 20% Kaolin Content | | | |
|---|---|---|---|---|
| Polymer | Bendtsen Roughness (ml $min^{-1}$) | Scott-Bond Strength (J $m^{-2}$) | Toner adhesion (%) | Tampering Evident |
| (a) | 59 | 83 | — | Yes |
| (b) | 61 | 110 | — | Yes |
| (c) | 51 | 71 | — | Yes |
| (d) | 36 | 75 | — | Yes |
| None (Control) | 46 | 81 | — (see below) | Borderline |

It was not possible to obtain numerical values for toner adhesion for the 20% kaolin content paper because delamination occurred.

It will be seen that the sheets which had a Scott-Bond strength above 150 J $m^{-2}$, i.e the sheets with 3% kaolin content, did not reveal evidence of tampering, even when they had been treated with thermally softenable polymer and had a Bendtsen roughness below 100 ml $min^{-1}$. By contrast, the corresponding 20% kaolin content papers with Scott-Bond strengths below 150 J $m^{-2}$ all showed evidence of tampering and delamination under the toner adhesion test. However, evidence of tampering for the control sheet with no thermally softenable polymer present was patchy, with only a minor degree of fibre disturbance apparent at intervals on the sheet surface. The control sheet was therefore judged unacceptable.

Attempts at removing toner with a scalpel from the surface of the 20% kaolin content polymer-treated papers, i.e. the papers according to the invention, resulted in very obvious damage to the surface of the papers. By contrast, it was possible to remove toner from the 3% filler content papers and the two untreated control papers with little or no visible surface damage.

The invention claimed is:

1. A paper adapted to receive toner-printed information thereon, wherein said paper:

(a) has a maximum Scott-Bond strength of 150 J $m^{-2}$;

(b) has a Bendtsen roughness of not more than about 150 ml $min^{-1}$; and (c) has been size pressed or otherwise treated with a thermally-softenable polymer composition, so that said paper is a security paper adapted to resist fraudulent alteration of toner-printed information thereon and to make such alteration or attempts at alteration evident, wherein internal cohesion of the paper is lower than inherent toner adhesion so that attempts to remove toner from the paper result in visually evident disruption of cellulose fibers in the paper.

2. Security paper as claimed in claim 1, wherein the Scott Bond strength of the paper is not more than 140 J $m^{-2}$.

3. Security paper as claimed in claim 2, wherein the paper has a filler content of about 15 to 20% by weight.

4. Security paper as claimed in claim 3, wherein the paper has a Bendtsen roughness value in the range 60 to 100 ml $min^{-1}$.

5. Security paper as claimed in claim 2, wherein the paper has a Bendtsen roughness value in the range 60 to 100 ml $min^{-1}$.

6. Security paper as claimed in claim 1, wherein the paper has a filler content of about 15 to 20% by weight.

7. Security paper as claimed in claim 6, wherein the paper has a Bendtsen roughness value in the range 60 to 100 ml $min^{-1}$.

8. Security paper as claimed in claim 3, wherein the paper has a filler content of at least about 15.4%.

9. Security paper as claimed in claim 6, wherein the paper has a filler content of at least about 17.8%.

10. Security paper as claimed in claim 6, wherein the paper has a filler content of at least about 18.4%.

11. Security paper as claimed in claim 1, wherein the paper has a Bendtsen roughness value in the range 60 to 100 ml $min^{-1}$.

12. Security paper as claimed in claim 1, wherein the thermally softenable polymer composition is derived form a latex or a colloidal dispersion.

13. Security paper as claimed in claim 12, wherein the thermally softenable polymer is incorporated in a starch surface sizing composition.

14. Security paper as claimed in claim 1, wherein the thermally softenable polymer composition comprises an acrylic polymer or copolymer, a polyvinyl acetate polymer, a vinyl acetate/ethylene copolymer, or a vinyl acetate/vinyl chloride/ethylene terpolymer.

15. Security paper as claimed in claim 14, wherein the thermally softenable polymer is incorporated in a starch surface sizing composition.

16. Security paper as claimed in claim 1, wherein the thermally softenable polymer composition comprises a styrene-acrylic copolymer.

17. Security paper as claimed in claim 16, wherein the thermally softenable polymer is incorporated in a starch surface sizing composition.

18. Security paper as claimed in claim 17, wherein the ratio of starch:styrene-acrylic copolymer is from 95:5 to 85:15 on a dry weight basis.

19. Security paper as claimed in claim 18, wherein the starch:styrene-acrylic copolymer mixture is present in an amount of about 5-6% on a dry basis, based on total dry weight of paper.

20. Security paper as claimed in claim 19, wherein the final dry paper has a basis weight of about 95 $gm^{-2}$ and a starch: styrene-acrylic copolymer mixture coatweight of about 2-2.5 $gm^{-2}$ per side.

21. Security paper as claimed in claim 18, wherein the ratio of starch:styrene-acrylic copolymer is about 90:10, on a dry weight basis.

22. A security document comprising a security paper as claimed in claim 1.

23. Security paper as claimed in claim 1, comprising a security feature.

24. Security paper as claimed in claim 1, wherein internal cohesion of the paper is lower than inherent toner adhesion so that attempts to remove toner from the paper result in visually evident disruption of cellulose fibers in the paper.

25. Security paper as claimed in claim 24, wherein the paper has a filler content of about 15 to 20% by weight.

26. Alteration resistant and tamper evident security document comprising a toner-printed information carried on a security paper according to claim 1.

27. Security document as claimed in claim 26, which is a bank cheque.

28. Security paper as claimed in claim 1, wherein the Scott Bond strength of the paper is not more than 130 J $m^{-2}$.

29. Security paper as claimed in claim 1, wherein the paper is a bank cheque paper which meets U.K. Clearing Bank Specification No. 1.

30. A method of producing a security document for the purpose of making toner-printed information subsequently applied to the security document more resistant to fraudulent alteration and of making such alteration or attempts at alteration evident, comprising:

providing a paper which (a) has a maximum Scott-Bond strength of 150 J $m^{-2}$;

(b) has a Bendtsen roughness of not more than about 150 ml $min^{-1}$; and (c) has been size pressed or otherwise treated with a thermally-softenable polymer composition, such that said paper is a security paper adapted to resist fraudulent alteration of toner-printed information thereon and to make such alteration or attempts at alteration evident, and forming a security document comprising said security paper.

31. Method as claimed in claim 30, wherein the paper is a bank cheque paper which meets U.K. Clearing Bank Specification No. 1.

* * * * *